US005387800A

United States Patent [19]

Kurtich et al.

[11] Patent Number: 5,387,800

[45] Date of Patent: Feb. 7, 1995

[54] PREFOCUSED LAMP AND REFLECTOR ASSEMBLY

[75] Inventors: Kevin M. Kurtich, Harwinton; Herman R. Riess, Torrington, both of Conn.

[73] Assignee: Dymax Corporation, Torrington, Conn.

[21] Appl. No.: 933,357

[22] Filed: Aug. 19, 1992

[51] Int. Cl.[6] ..... F41J 9/13

[52] U.S. Cl. ..... 250/504 R; 250/493.1; 250/503.1

[58] Field of Search ..... 250/493.1, 503.1, 504 R; 362/285, 296, 306, 365, 372

[56] References Cited

U.S. PATENT DOCUMENTS

| | | | |
|---|---|---|---|
| 4,560,883 | 12/1985 | Kerschgens | 250/504 R |
| 4,608,624 | 8/1986 | Blaisdell et al. | 362/306 |
| 4,668,869 | 5/1987 | Matosian et al. | 250/504 R |
| 5,050,044 | 9/1991 | Shibamaya | 362/285 |

FOREIGN PATENT DOCUMENTS

| | | | |
|---|---|---|---|
| 0149020 | 6/1981 | Germany | 250/504 R |

OTHER PUBLICATIONS

"Scientific, Medical and Dental Lamp" USHIO Manual.
"Micropositioning Equipment"-p. 43.
"Introduction to Positioning"& DAEDAL Positioning Systems & Controls.
"Halomet HTI".
"USHIO USH Series Super High-Pressure Mercury Lamps for Semiconductor Industry".
"GE High-Intensity Arc Lamps"; Automatic Light Sources and Replacement Parts; Photomax Lamp Housing.
"Spindler & Hoye".
"Reflector MR-16".

*Primary Examiner*—Jack I. Berman
*Assistant Examiner*—James Beyer
*Attorney, Agent, or Firm*—Ira S. Dorman

[57] ABSTRACT

A prefocused lamp and reflector assembly comprises an elongated lamp having opposite end portions that extend through aligned openings in the wall defining the reflective cavity. The end portions of the lamp are engaged in receptacle portions on the base of the assembly, and the reflector is affixed to the base in a position empirically focused to afford maximum radiation output intensity.

15 Claims, 1 Drawing Sheet

PREFOCUSED LAMP AND REFLECTOR ASSEMBLY

BACKGROUND OF THE INVENTION

Lamp assemblies are commercially available in which the relative positions of the lamp and the reflector are so fixed at the point of manufacture as to maximize output radiation intensity. Such units are employed in a wide variety of applications, typically for the production of ultraviolet radiation used, for example, in effecting the curing of photoinitiated adhesives and coating compositions. Presently available assemblies of this kind are not however entirely satisfactory from a number of standpoints.

The lamps utilized are generally of an elongate shape, with the electrical contacts on opposite end portions of the envelope and the emitting element (e.g., the arc of a mercury vapor lamp) centrally disposed therebetween. Heretofore, such lamps have been mounted with their longitudinal axes coincident with the central axis of the associated reflector, such that one of the end portions extends inwardly and is affixed within the reflector body with the opposite end portion extending outwardly in front of the reflective cavity. Not only is manufacture difficult, and the resultant assemblage somewhat insecure from a structural standpoint, but also such an arrangement may be impractical for certain lamps; i.e., the longer it is (e.g., the length of a 100-watt lamp, versus that of a 50-watt lamp) the deeper the reflector would have to be to accommodate it. Moreover, the conventional mounting undesirably disposes one of the electrical connections in the path of irradiation, and disposes the lamp itself in a horizontal attitude in normal use; vertical orientation is believed to extend bulb life, at least to some degree.

SUMMARY OF THE INVENTION

Accordingly, it is a broad object of the present invention to provide a prefocused lamp and reflector assembly in which the foregoing disadvantages are reduced or avoided.

A more specific object of the invention is to provide such an assembly in which an elongate lamp is disposed with its axis transverse to, rather than coincident with, the central axis of the reflector.

Related objects are to provide such an assembly in which the lamp is supported at both of its opposite ends by secure mounting means, and in such position as to dispose no portion in the radiation path.

Additional objects are to provide such an assembly in which the lamp is prefocused to achieve optimal intensity, and is adapted to operate at a vertical attitude.

Another broad object of the invention is to provide a novel method for fabricating a lamp and reflector assembly having the features and advantages set forth.

It has now been found that certain of the foregoing and related objects of the invention are attained by the provision of a prefocused assembly that comprises a base, a reflector, and an elongate lamp. The base includes a reflector-supporting portion and lamp-mounting means, the latter having a pair of receptacle portions spaced to opposite sides of the reflector-supporting portion and in general alignment with one another on a rectilinear axis. The reflector is rigidly affixed to the reflector-supporting portion of the base, and comprises forward wall structure that defines a forwardly directed reflective cavity, which has a central axis that substantially intersects the rectilinear axis lying between the receptacle portions of the lamp-mounting means. Opposing portions of the forward wall structure are formed with holes that are aligned substantially on that axis, and opposite end portions of the lamp extend through the holes and into engagement in the receptacle portions of the lamp-mounting means. The lamp is positioned with respect to the reflective cavity so as to optimally focus the radiation that it emits.

The reflector will normally be secured to the reflector-supporting portion of the base by use of a bonding material, which will preferably be a ceramic of high temperature resistance and low thermal expansion. Most desirably the reflector-supporting portion will include a fixture member that projects into a rearwardly opening cavity defined in the reflector, and is at least partially embedded in the bonding material.

The holes in the opposing sections of the forward wall structure will be substantially larger than the corresponding cross sectional dimensions of the end portions of the lamp, so as to provide substantial clearance for adjustment of lamp position. In most cases the structure will be of uniform parabolic cross section in all planes that include, and are rotated about, its central axis. The element of the lamp will normally be disposed within the reflective cavity, and typically a mercury vapor lamp, for generating ultraviolet radiation, will be employed.

Other objects of the invention are attained by the provision of a method for the fabrication of a lamp assembly, utilizing the components described. In accordance therewith, the lamp is initially inserted into the reflector with its opposite end portions extending through the holes thereof, following which the end portions are engaged in the receptacle portions of the lamp-mounting means. With the lamp in operation, and the reflector oriented with its reflective cavity directed forwardly away from the base, the relative positions of the reflector and lamp are adjusted on three mutually perpendicular axes so as to optimize radiation output from the unit. The reflector and lamp are then secured, as necessary, to affix them in their so adjusted positions; normally, the lamp will have previously been mounted in a fixed position, with the reflector being adjusted and then affixed in position on the reflector-supporting portion of the base.

In the preferred embodiments, a two-phase procedure will be used to secure the reflector to the base. The first phase will comprise the application, to the reflector and base, of a synthetic resinous adhesive material, and the curing thereof so as to maintain the adjusted position of the reflector. The second phase of the procedure will comprise the application and solidification of a different material (e.g., a ceramic) to more permanently affix the reflector in position. The method may additionally include a step of applying a material to the receptacle portions of the lamp-mounting means and the opposite end portions of the lamp, to bond them to one another.

DETAILED DESCRIPTION OF THE ILLUSTRATED EMBODIMENT

Figure 2:
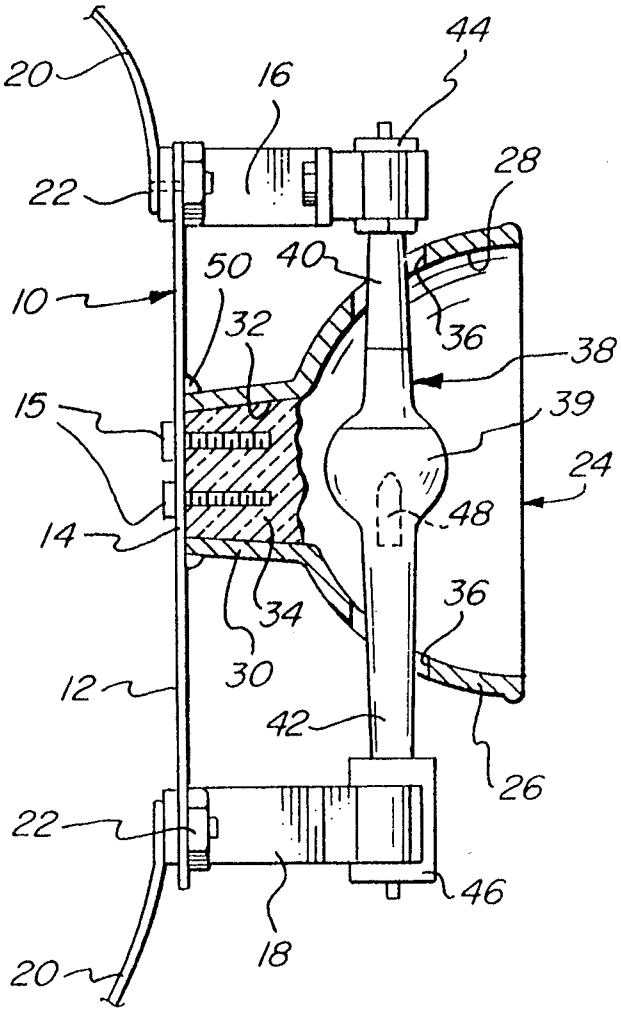
FIG. 2 is a side elevational view of the assembly showing, in section, the reflector and the mass of permanent bonding material.
Figure 1:
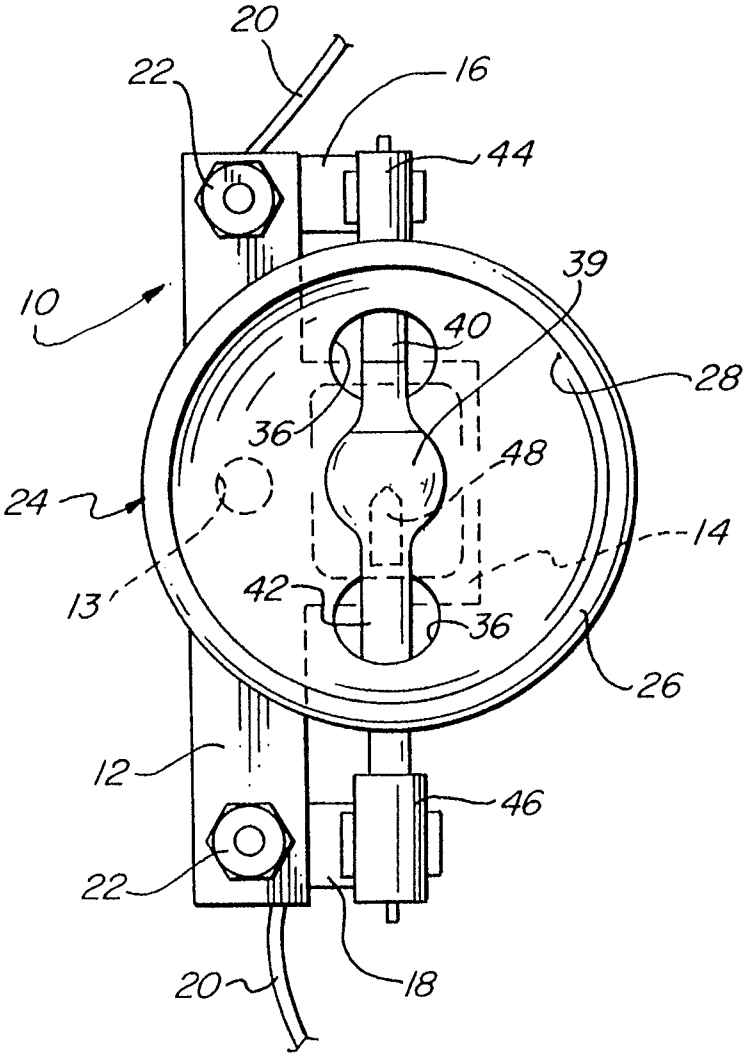
FIG. 1 is a front elevational view of an assembly embodying the present invention.

Turning now in detail to the appended drawing, therein illustrated is a lamp and reflector assembly embodying the present invention. It consists of a base, generally designated by the numeral 10, made of a strip 12 of nonconductive fiberboard (e.g., a filament/resin composite), from which projects laterally an integrally formed rectangular tab portion 14. Upper and lower metal spring clips 16 and 18, respectively, extend from the opposite ends of the strip 14, and electrical wires 20 connect thereto under the fasteners 22.

A parabolic reflector, generally designated by the numeral 24, is affixed on the base 10 and has wall structure 26 of circular cross section (taken in planes to which its central axis is normal) defining the reflective cavity 28, a dichroic coating being provided on its inner surface. Rearward wall structure 30 defines a second, rearwardly opening cavity 32 (as a continuation of the cavity 28), into which extend two studs 15 that are securely affixed to the central portion 18 of the base 10 and project forwardly from it. A ceramic potting compound 34 is contained within the rearward cavity 32 and encapsulates the studs 15, thereby producing a rigid, permanent, heat-resistant and dimensionally stable interconnection between the reflector 24 and the base 10.

The wall structure 26 defining the forward portion of the reflector 24 has formed through it a pair of holes 36, which are oppositely aligned with one another on a diametric axis through the reflector. The lamp, generally designated by the numeral 38, is of elongate shape, and has a central bulb portion 39 from which extend coaxial opposite end portions 40, 42, each of which has an electrical connector 44, 46, thereon for conducting current to the radiation-emitting element 48. The opposite end portions 40, 42 extend through the holes 36 in the reflector into engagement with the spring clips 16, 18, which serve not only to securely mount the bulb 38 but also to establish electrical connections to the wires 20 (which are of course provided for connection to a power supply, not shown).

In order to establish an optimal position of the lamp element 48 relative to the reflector 24, normally for focusing the emitted radiation to produce maximum intensity, the following procedure will preferably be employed. The reflector 24 and lamp 38, mounted on the base 10, will be supported in a so-called "X,Y,Z fixture" (not shown), which is constructed to permit relative movement on three, mutually perpendicular axes; the fiberboard strip 12 is provided with a threaded hole 13 for engagement of a mounting screw on the fixture. With the lamp on, the position of the reflector will be so adjusted as to register a maximum reading on a radiometer onto which the beam has been caused to impinge. Thus, focusing is done empirically, and on a case-by-case basis; dimensional assembly (i.e., assembly following manufacturers' data, or based upon data obtained from other ostensibly identical lamps, reflectors, and lamp/reflector combinations) has been found to be unreliable for the achievement of optimal radiation output.

After focusing, the reflector will be lightly bonded to the central portion 14 of the base 10, as at 50; an acrylate adhesive such as the LIGHT-WELD product that is commercially available from Dymax Corporation, of Torrington, Conn., will advantageously be used for that purpose. Following removal of the resultant preassembly from the X,Y,Z fixture, a ceramic potting material will be introduced into the rearward cavity 32 of the reflector, and permitted to harden. Although not essential, it is most advantageous to apply the ceramic material to the joints formed between the spring clips 16, 18 and the engaged portions of the lamp 38, not only to strengthen the assembly but also to discourage tampering; even slight relative displacement of the lamp and reflector can significantly reduce the intensity of the radiation produced, as will be evident from the foregoing discussion concerning empirical focusing.

Many variations may of course be made in the assembly and method described hereinabove without departure from the concepts underlying the present invention. Thus, the shapes and specific features of the components of the assembly may deviate substantially, as may the nature of any materials of construction described. Although a parabolic reflector has for example been described and illustrated, other forms of reflectors, such as elliptical, can of course be used, and needless to say, the nature of the radiation emitted by the lamp is not to be regarded as a limiting factor. Also, while focusing of the radiation emitted is preferably accomplished by adjustment of the reflector position, the same results could be achieved by movement of the bulb, in which case the mounting means would of course be constructed to afford that capability. Rather than employing studs projecting from the base into a cavity of the reflector, a mechanical member surrounding its rearward structure, and filled with a bonding material, may provide the desired added support. Finally, it will be appreciated that reference herein to "different" materials is to be broadly construed, so as to encompass materials of the same chemical species, but having properties that distinguish them from one another.

Hence, it can be seen that the present invention obviates deficiencies of prior similar units, as pointed out above. It provides a novel, prefocused lamp assembly in which an elongate lamp is disposed with its axis transverse to, rather than coincident with, the central axis of the reflector. The lamp is advantageously supported at both of its opposite ends by secure mounting means, and has no portion disposed in the radiation path. Prefocusing to achieve optimal intensity is facile, and the unit is adapted to operate with the lamp at a vertical attitude. The invention also provides a novel method for fabricating a lamp and reflector assembly having the features and advantages set forth.

Having thus described the invention, what is claimed is:

1. A prefocused lamp assembly, comprising:

a bracket, including a reflector-supporting portion and lamp-mounting means, said lamp-mounting means having a pair of arm members spaced to opposite sides of said reflector-supporting portion and extending forwardly therefrom, said arm members having receptacle portions thereon in general alignment with one another on a rectilinear axis;

a reflector rigidly affixed to said reflector-supporting portion of said bracket and comprising forward wall structure defining a forwardly directed reflective cavity with a central axis that substantially intersects said rectilinear axis, said forward wall structure having opposing portions with holes therethrough aligned substantially on said rectilinear axis; and an elongate lamp having opposite end portions with electrical contacts thereon, and an element therebetween for emitting radiation, said end portions of said lamp extending through said holes of said opposing portions of said forward wall structure and being engaged in said receptacle portions of said lamp-mounting means, said lamp being so positioned with respect to said reflective cavity as to optimally focus the radiation emitted thereby.

2. The assembly of claim 1 wherein said reflector is secured to said reflector-supporting portion of said bracket with a bonding material.

3. The assembly of claim 2 wherein said bonding material is a heat-resistant ceramic having a low coefficient of thermal expansion.

4. A prefocused lamp assembly, comprising:

a base, including a reflector-supporting portion and lamp-mounting means, said lamp-mounting means having a pair of receptacle portions spaced to opposite sides of said reflector-supporting portion and in general alignment with one another on a rectilinear axis;

a reflector rigidly affixed to said reflector-supporting portion of said base and comprising forward wall structure defining a forwardly directed reflective cavity with a central axis that substantially intersects said rectilinear axis, said forward wall structure having opposing portions with holes therethrough aligned substantially on said rectilinear axis; and an elongate lamp having opposite end portions with electrical contacts thereon, and an element therebetween for emitting radiation, said end portions of said lamp extending through said holes of said opposing portions of said forward wall structure and being engaged in said receptacle portions of said lamp-mounting means, said reflector being secured to said reflector-supporting portion of said base with a bonding material, and said reflector-supporting portion of said base including at least one fixture member projecting therefrom, said fixture member being at least partially embedded in said bonding material, said lamp being so positioned with respect to said reflective cavity as to optimally focus the radiation emitted thereby.

5. The assembly of claim 4 wherein said reflector has rearward wall structure defining a rearwardly opening cavity, said rearwardly opening cavity containing said bonding material and having said fixture member projecting thereinto.

6. A prefocused lamp assembly, comprising:

a base, including a reflector-supporting portion and lamp-mounting means, said lamp-mounting means having a pair of receptacle portions spaced to opposite sides of said reflector-supporting portion and in general alignment with one another on a rectilinear axis;

a reflector rigidly affixed to said reflector-supporting portion of said base and comprising forward wall structure defining a forwardly directed reflective cavity with a central axis that substantially intersects said rectilinear axis, said forward wall structure having opposing portions with holes therethrough aligned substantially on said rectilinear axis; and an elongate lamp having opposite end portions with electrical contacts thereon, and an element therebetween for emitting radiation, said end portions of said lamp extending through said holes of said opposing portions of said forward wall structure and being engaged in said receptacle portions of said lamp-mounting means, said holes in said opposing portions of said forward wall structure being substantially larger than the cross sectional dimensions of said end portions of said lamp extending therethrough, so as to provide substantial clearance between said lamp end portions and the edges of said wall portions defining said holes for varying the relative positions of said reflector and lamp on three mutually perpendicular axes prior to affixation of said reflector on said base, said lamp being so positioned with respect to said reflective cavity as to optimally focus the radiation emitted thereby.

7. The assembly of claim 1 wherein said end portions of said lamp are affixed in said receptacle portions of said lamp-mounting means with a bonding material.

8. The assembly of claim 1 wherein said lamp is a mercury vapor lamp for generating ultraviolet radiation.

9. The assembly of claim 1 wherein said receptacle portions of said lamp-mounting means have electrical contacts thereon, and wherein said respective contacts of said receptacle portions and of said end portions of said lamp are in mutual electrical contact.

10. A method for the fabrication of a prefocused lamp assembly, comprising the steps:

providing a base, a reflector, and an elongate lamp, said base including a reflector-supporting portion and lamp-mounting means, said lamp-mounting means having a pair of receptacle portions spaced to opposite sides of said reflector-supporting portion and in general alignment with one another on a rectilinear axis; said reflector comprising forward wall structure defining a forwardly directed reflective cavity with a central axis, and having opposing portions with aligned holes therethrough; and said elongate lamp having opposite end portions with electrical contacts thereon, and an element therebetween for emitting radiation;

assembling said lamp and said reflector with said opposite end portions of said lamp extending through said holes of said opposing portions of said reflector forward wall structure, said holes in said opposing portions of said forward wall structure being substantially larger than the cross sectional dimensions of said end portions of said lamp extending therethrough, so as to provide substantial clearance between said lamp end portions and the edges of said wall portions defining said holes;

engaging said opposite end portions of said lamp in said receptacle portions of said lamp-mounting means of said base;

with said lamp in operation and said reflector oriented with said reflective cavity directed away from said base, adjusting the relative positions of said reflector and said lamp on three mutually perpendicular axes so as to optimize the radiation output of the assembly; and securing said reflector and said lamp as necessary to affix them in their so adjusted positions.

11. The method of claim 10 wherein said lamp is mounted in a fixed position by said engaging step, wherein said reflector position is adjusted in said adjusting step, and wherein said reflector is secured in said securing step.

12. The method of claim 11 wherein said reflector is secured to said base by a two-phase procedure, the first phase of said procedure comprising the application of a synthetic resinous adhesive material to said reflector and base, and the curing thereof so as to maintain said adjusted position of said reflector; and the second phase thereof comprising the application and solidification of a different material for more permanently affixing said reflector in said position, said different material being of a highly heat-resistant, dimensionally stable, rigid character.

13. The method of claim 12 wherein said reflector has rearward wall structure defining a rearwardly opening cavity, wherein said reflector-supporting portion of said base includes at least one fixture member projecting therefrom, wherein said reflector and base are assembled with said fixture member projecting into said rearwardly opening cavity, and wherein said different material is introduced into said rearwardly opening cavity so as to embed said fixture member therein.

14. The method of claim 12 wherein said different material is a ceramic.

15. The method of claim 10 including the additional step of applying a bonding material to said receptacle portions of said lamp-mounting means and the associated opposite end portions of said lamp so as to affix them against disengagement.

* * * * *

UNITED STATES PATENT AND TRADEMARK OFFICE

CERTIFICATE OF CORRECTION

PATENT NO. : 5,387,800
APPLICATION NO. : 07/933357
DATED : February 7, 1995
INVENTOR(S) : Kevin M. Kurtich and Herman R. Reiss It is certified that error appears in the above-identified patent and that said Letters Patent is hereby corrected as shown below:

Title page item [75] change the spelling of inventor "Herman R. Riess" to -- Herman R. Reiss --.

Signed and Sealed this

Eleventh Day of November, 2008

JON W. DUDAS
*Director of the United States Patent and Trademark Office*